US007810793B1

(12) United States Patent
Chiang et al.

(10) Patent No.: US 7,810,793 B1
(45) Date of Patent: Oct. 12, 2010

(54) PULLEY ACTUATOR

(75) Inventors: Hsin-An Chiang, Taichung (TW); Jin-Cheng Lin, Taichung (TW)

(73) Assignee: Hiwin Mikrosystem Corp., Taichung (TW)

( * ) Notice: Subject to any disclaimer, the term of this patent is extended or adjusted under 35 U.S.C. 154(b) by 0 days.

(21) Appl. No.: 12/456,485

(22) Filed: Jun. 17, 2009

(51) Int. Cl.
*B66D 3/08* (2006.01)

(52) U.S. Cl. ..... 254/397; 254/394; 254/396; 211/117; 212/348; 248/328

(58) Field of Classification Search ..... 254/394, 254/396, 397, 398, 399; 211/117; 212/348; 248/328
See application file for complete search history.

(56) References Cited

U.S. PATENT DOCUMENTS 326,336 A * 9/1885 Sandberg et al. ..... 212/264
3,902,070 A * 8/1975 Amor et al. ..... 378/194
5,533,593 A * 7/1996 Huang ..... 182/141
5,733,096 A * 3/1998 Van Doren et al. ..... 414/744.3
6,234,453 B1 * 5/2001 Block ..... 254/285
6,942,198 B2 * 9/2005 Huang ..... 254/387
7,195,216 B2 * 3/2007 Wang ..... 248/157
7,357,376 B2 * 4/2008 Assmann ..... 254/337
7,389,974 B2 * 6/2008 Garrec ..... 254/394
7,588,232 B2 * 9/2009 Wei et al. ..... 254/337
7,647,659 B2 * 1/2010 Frolik et al. ..... 5/509.1

* cited by examiner

*Primary Examiner*—Emmanuel M Marcelo
(74) *Attorney, Agent, or Firm*—Charles E. Baxley

(57) ABSTRACT

A pulley actuator implements a motor to drive a screw and a guide rod to relatively expand or retract while utilizing one flexible rope and two pulleys to drive three telescoped tubes to relatively expand or retract move correspondingly. The pulley actuator has a simplified structure as compared with the known devices and is easy to fabricate.

10 Claims, 8 Drawing Sheets

PULLEY ACTUATOR

BACKGROUND OF THE INVENTION

1. Technical Field

The present invention relates to actuators and, more particularly, to a pulley actuator.

2. Description of Related Art

A conventional pulley actuator to be used in long-travel applications, such as a lifting mechanism for hospital beds or tables, is shown in FIG. 1. The pulley actuator is driven by a motor 11 and implements a reducing mechanism 12 to transmit the rotational driving force to a screw 13 so that the rotating screw 13 is enabled to stretch or retract a guide rod 14 coupled therewith. A first tube 15, a second tube 16, and a third tube 17 are telescoped in an inward order and jointly shield the screw 13. A first pulley 141 is provided at a distal end of the guide rod 14. A first rope 142 has one end fixed to the reducing mechanism 12 while having an opposite end mounted around the first pulley 141 to be then fixedly coupled with the distal end of the guide rod 14 and adjacent to the first pulley 141. A second pulley 143 is settled aside a proximal end of the guide rod 14. A second rope 144 has one end fixed inside a distal end of the third tube 17 while having an opposite end mounted around the second pulley 143 to be then fixedly inside a distal end of the first tube 15.

The actuator depicted in FIG. 1, however, has its defects.

Since the pulley actuator employs two pulleys and two ropes for transmission, the ropes need separate installation and adjustment in each time of fabrication or maintenance, thus inconveniencing its user.

Besides, to disassemble the installed pulley actuator that has the first tube 15 coupled with the reducing mechanism 12 and the third tube 17 fixed to or welded to a bed or a table, the motor 11, the reducing mechanism 12, the first tube 15, the second tube 16 and the third tube 17 have to be detached successively, which is also detrimental to convenient maintenance.

SUMMARY OF THE INVENTION

In view of the shortcomings of the prior art device, one objective of the present invention is to provide a pulley actuator, which has a simplified and reliable configuration.

Another objective of the present invention is to provide a pulley actuator, which allows easy disassembly and maintenance.

Another objective of the present invention is to provide a pulley actuator, which allows easy travel adjustment thereof.

To achieve these and other objectives of the present invention, the disclosed pulley actuator comprises:

a motor, outputting a rotational force to a reducing mechanism through a coupling device for the reducing mechanism to transmit the rotational force to a screw that is coupled with a guide rod, wherein the guide rod has one end adjacent to the screw provided with a guide seat, and an opposite end equipped with a first pulley, in which the guide seat includes a second pulley settled at a lateral thereof;

a tube assembly, including a first tube, a second tube and a third tube telescoped in an outward order, wherein the first tube is coaxially mounted around the screw, and a sleeve coaxially extends inside the third tube from a bottom of the third tube toward the reducing mechanism for receiving the guide rod therein, the sleeve having a pressing block settled at a proximal end thereof; and a flexible rope, having one end fixed to the reducing mechanism and an opposite end passing around the first pulley and the second pulley, and then fixed inside a distal end of the first tube with a middle portion pressed by the pressing block.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawing, wherein.

DETAILED DESCRIPTION OF THE PREFERRED EMBODIMENT

Figure 1:
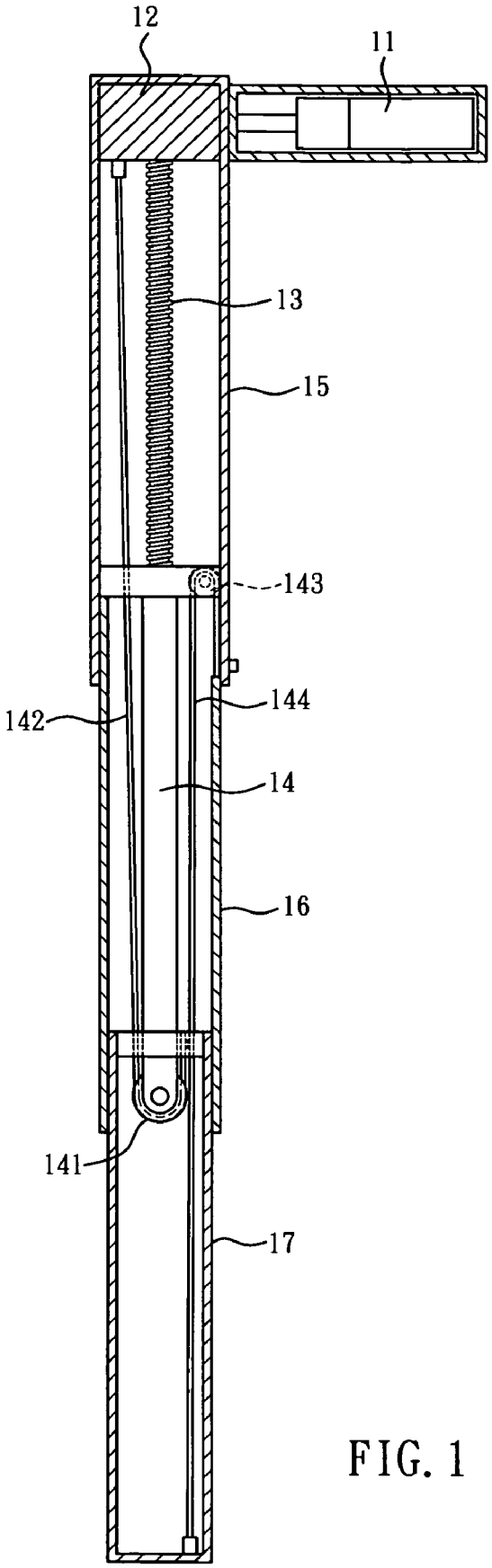
FIG. 1 PRIOR ART
FIG. 1 is a sectional view of a conventional pulley actuator.
Figure 2:
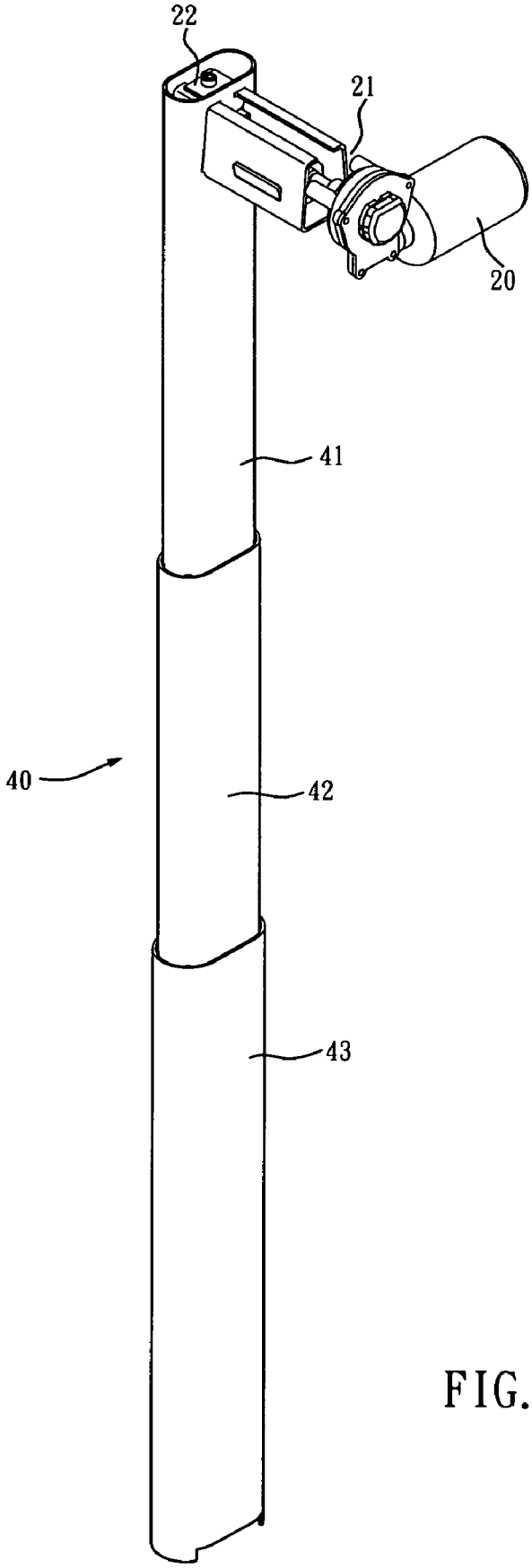
FIG. 2 is a perspective view of a pulley actuator of the present invention.
Figure 3:
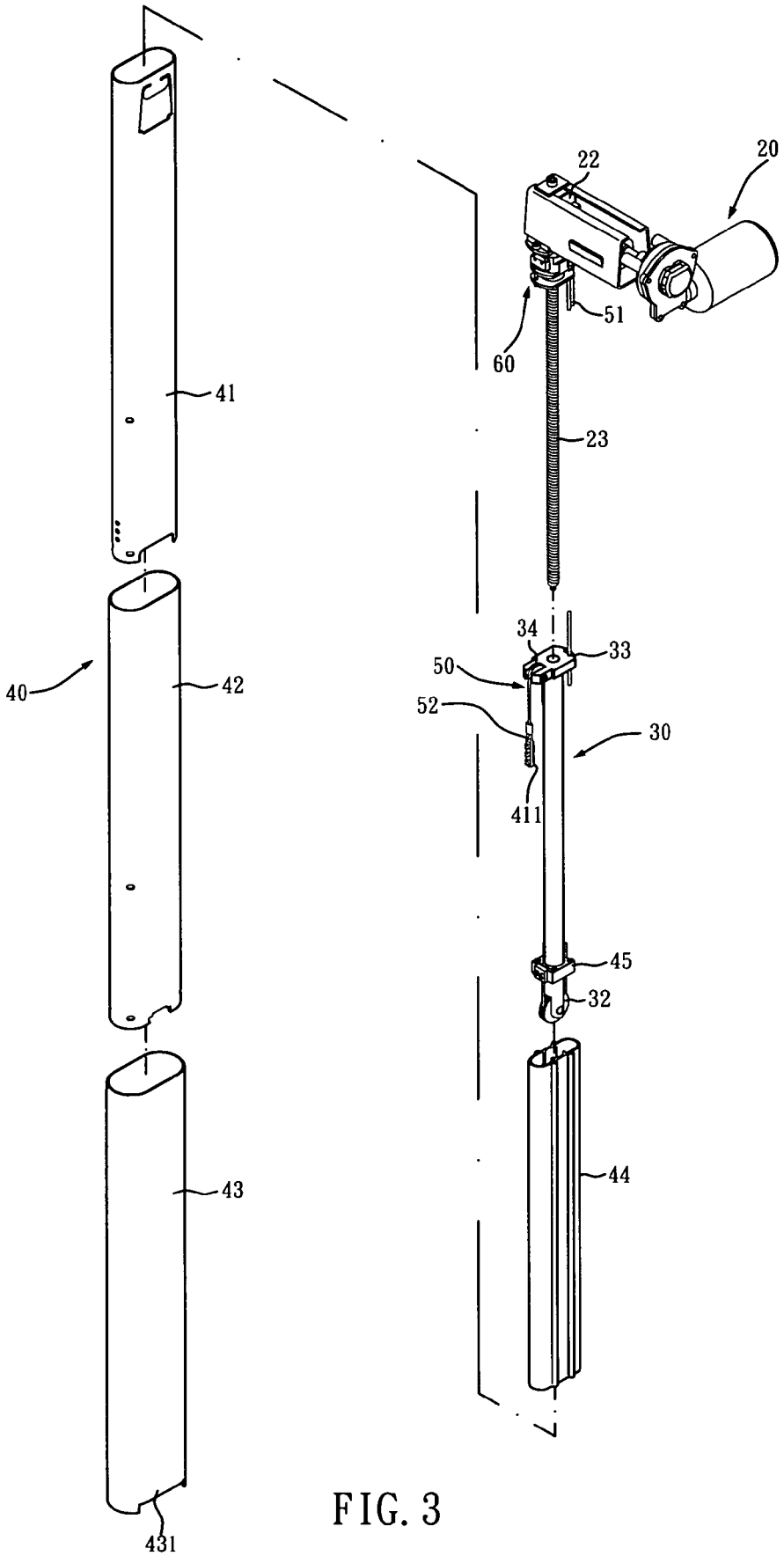
FIG. 3 is an exploded view of the pulley actuator of the present invention.
Figure 4:
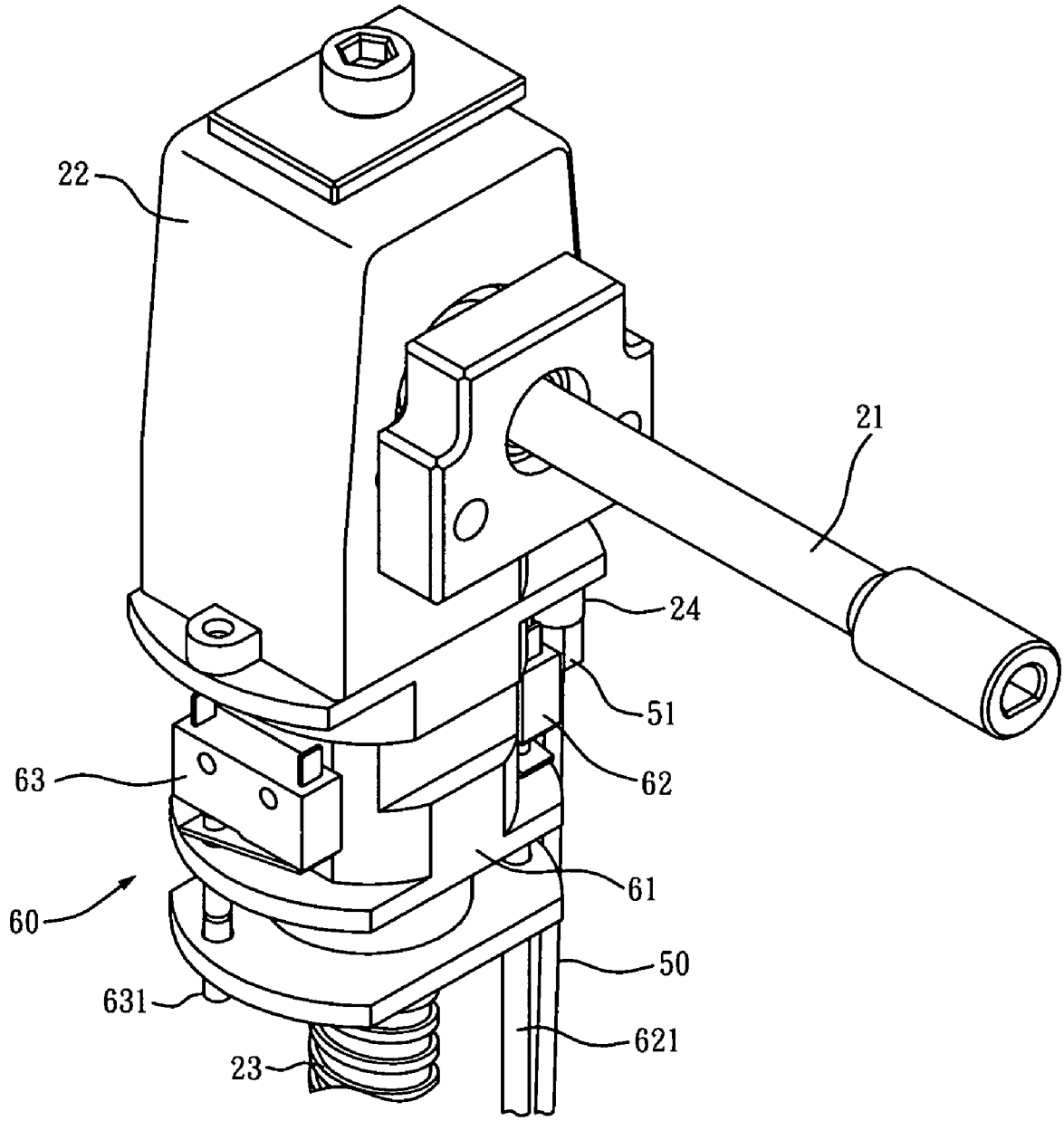
FIGS. 4 through 6 are partial exploded views of the pulley actuator of the present invention.
Figure 5:
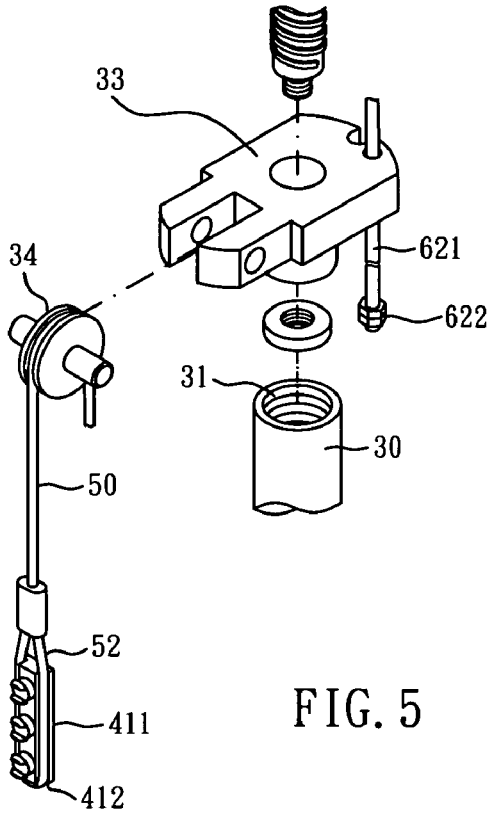
Figure 6:
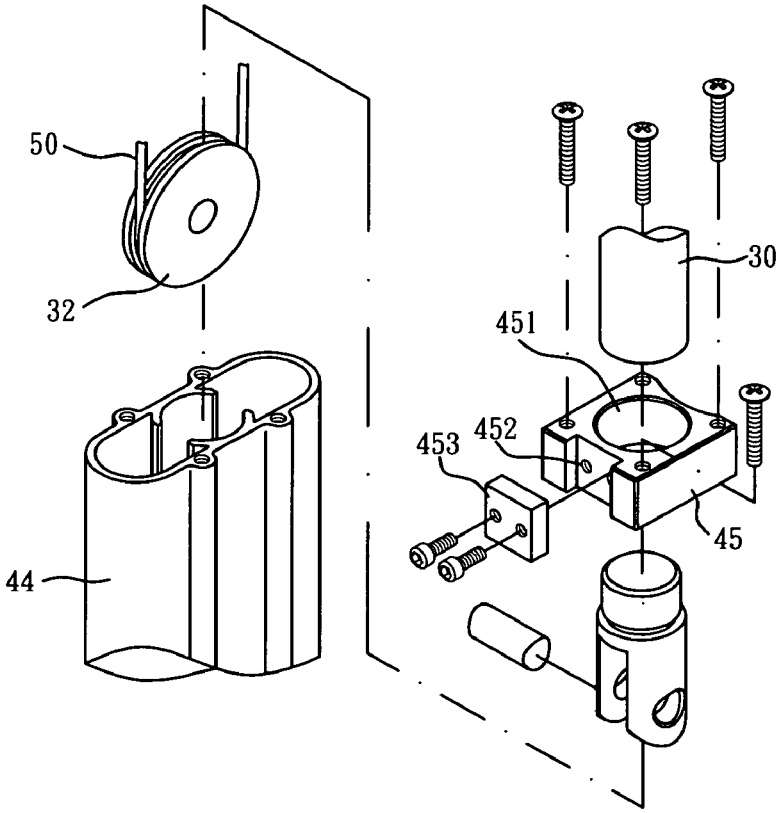

While a preferred embodiment is provided hereinafter for illustrating the concept of the present invention as described above, it is to be understood that the components of the embodiment shown in the accompanying drawings are depicted for the sake of easy explanation and need not to be made in scale.

Please refer to FIGS. 2 through 7 for a pulley actuator of the present invention. The pulley actuator primarily comprises a motor 20, a guide rod 30, a tube assembly 40, a flexible rope 50, and a sensing device 60.

The motor 20 outputs a rotational force to a reducing mechanism 22 through a coupling device 21 and then the reducing mechanism 22 transmits the rotational force to a screw 23. Besides, an adjustment base 24 formed with a threaded hole is provided at a lateral of the reducing mechanism 22.

The guide rod 30 is a hollow rod formed therein with threads for being coupled with the screw 23. The guide rod 30 has one end far from the screw 23 provided with a first pulley 32, and one opposite end adjacent to the screw 23 provided with a guide seat 33. The guide seat 33 includes a second pulley 34 settled at a lateral thereof.

The tube assembly 40 includes a first tube 41, a second tube 42 and a third tube 43 telescoped in an outward order. The first tube 41 is coaxially mounted around the screw 23 and has a fixing seat 411 installed therein near a proximal end thereof. Furthermore, the fixing seat 411 is peripherally formed with a groove 412. The third tube 43 is ended by a bottom 431 at a distal end thereof. A sleeve 44 coaxially extends inside the third tube 43 from the bottom 431 toward the reducing mechanism 22. A positioning seat 45 settled at a proximal end of the sleeve 44 has an axial hole 451 for receiving the guide rod 30 and a lateral recess 452 for allowing a pressing block 453 to be screwed thereto.

The flexible rope 50 may be a steel cable or any other flexible element. The flexible rope 50 has one end provided with an adjustment member 51 and an opposite end formed as a looped portion 52. After the adjustment member 51 is coupled with the adjustment base 24, the flexible rope 50 is arranged along a route passing around the first pulley 32, passing through the recess 452, and passing around the second pulley 34, and then has the looped portion 52 coupled with the groove 412 so that the flexible rope 50 is fixed to the fixing seat 411. The adjustment member 51 is moveably coupled with the adjustment base 24 so that the length of the flexible rope 50 is adjustable. Meantime, the pressing block 453 serves to press the flexible rope 50 against the positioning seat 45 at a middle portion of the flexible rope 50 so that the flexible rope 50 is enabled to drive the sleeve 44 to move.

The sensing device 60 has a sensing seat 61 provided outside the screw 23 of the reducing mechanism 22. An expanding limit switch 62 and a retracting limit switch 63 are settled on the sensing seat 61. The expanding limit switch 62 comprises a long shaft 621 that passes successively through the sensing seat 61 and the guide seat 33, and has a retaining nut 622 settled at a distal, free end thereof. The long shaft 621 has a length approximately equal to the maximum distance between the guide seat 33 and the expanding limit switch 62. The retracting limit switch 63 comprises a short shaft 631 that passes through the sensing seat 61 and has a distal, free end slightly jutting out of the sensing seat 61.

Figure 7:
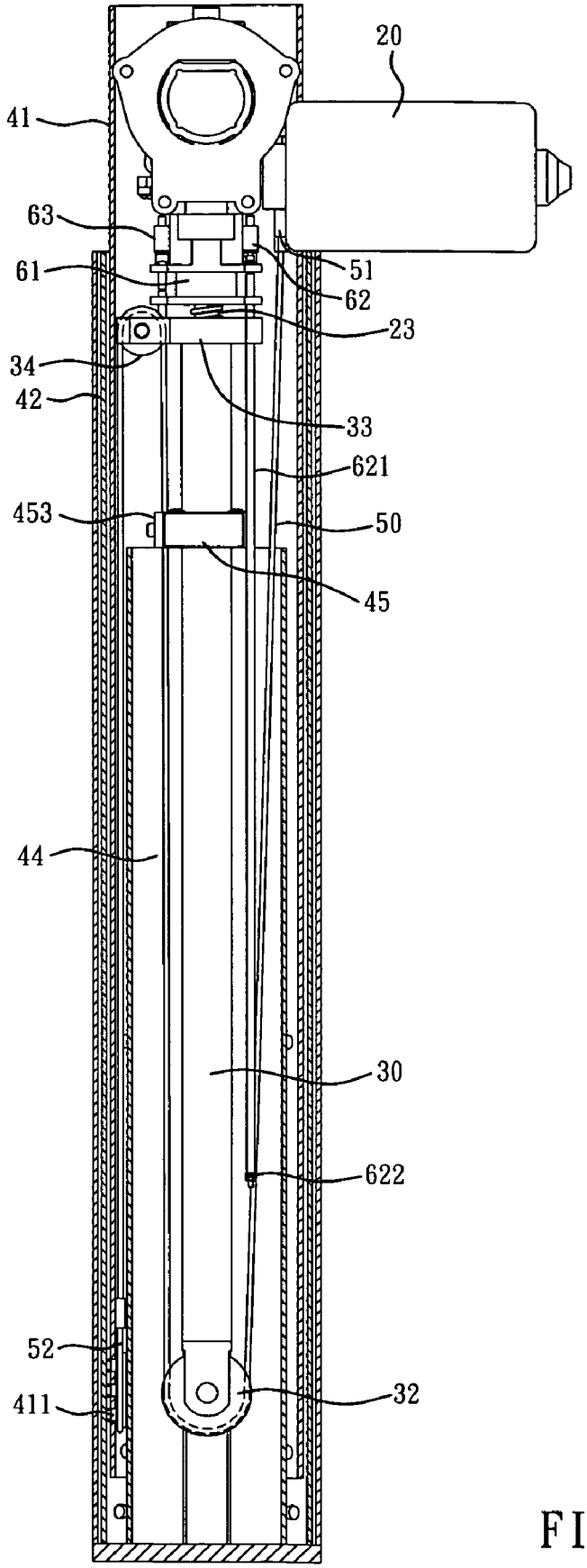
FIGS. 7 through 9 illustrate operation of the pulley actuator of the present invention.
Figure 8:
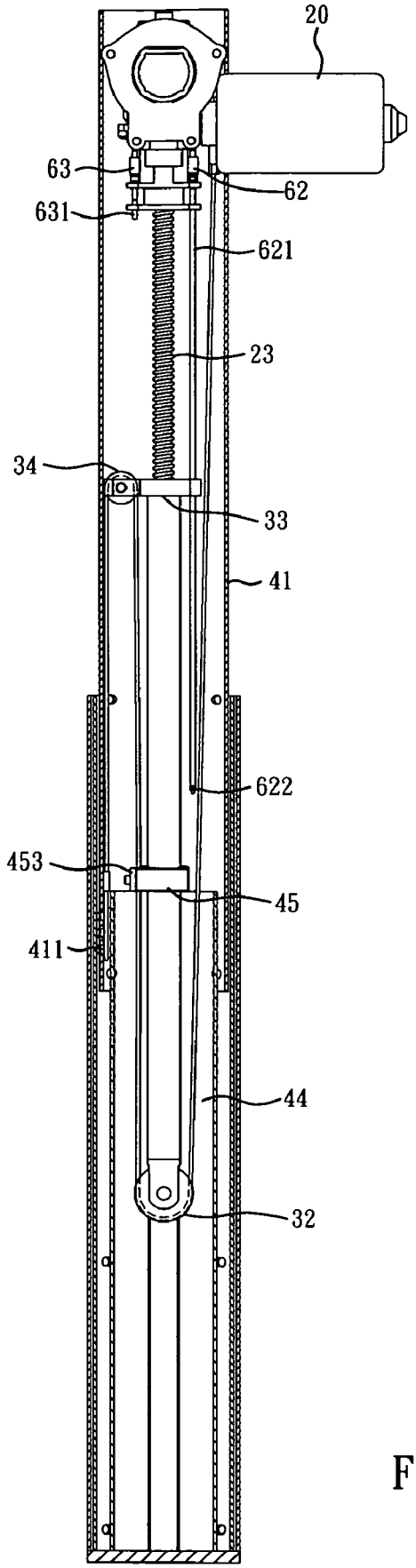
Figure 9:
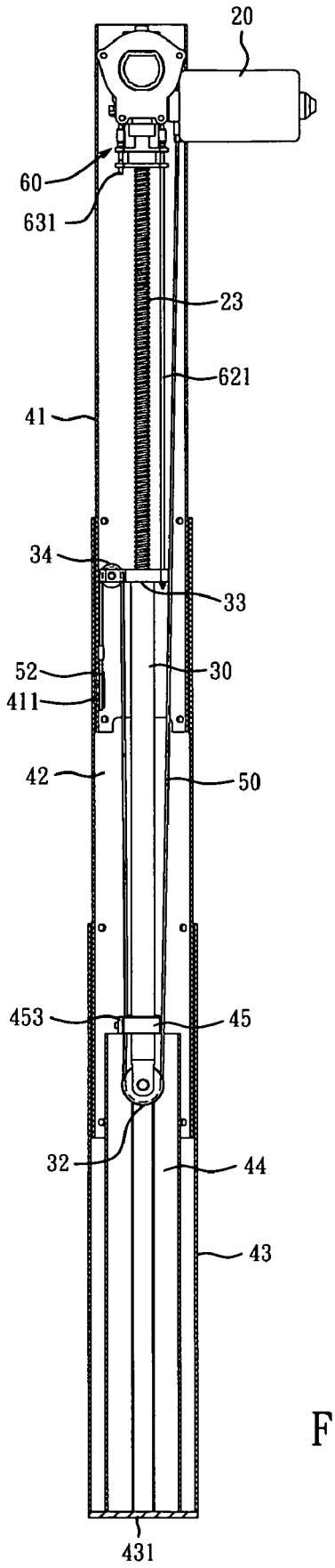

Referring to FIG. 7, when the disclosed pulley actuator is initially in its retracted position, the screw 23 is almost completely received in the guide rod 30 while the first tube 41 as well as the second tube 42 accommodated in the third tube 43. After the motor 20 is actuated, the coupling device 21 passes the rotational force of the motor 20 to the reducing mechanism 22 for rotating the screw 23. At this time, sine the guide seat 33 is such configured that it is prevented from rotating in the first tube 41, the guide seat 33 slides toward the distal end of the guide rod 30 instead of rotating with the screw 23. With the movement of the guide rod 30, the distance between the adjustment member 51 and the first pulley 32 increases, so that the flexible rope 50, coupled with the positioning seat 45 by means of the recess 452 and the pressing block 453, draws the first pulley 32 outward the distal end of the sleeve 44, as shown in FIG. 8. Consequently, the guide rod 30 leaving the sleeve 44 drives the second pulley 34 to move the looped portion 52 of the flexible rope 50 and the fixing seat 411 coupled therewith. As a result, the first tube 41 extends outward from the second tube 42.

Since the long shaft 621 has the length approximately equal to the maximum distance between the guide seat 33 and the expanding limit switch 62, when the screw 23 extends outward from the guide rod 30 to an expanding limit, the retaining nut 622 causes the long shaft 621 to separate from the expanding limit switch 62 so that the expanding limit switch 62 sends a stop signal to prevent the motor 20 from further operation.

On the contrary, when the motor 20 gives a reverse rotational force, the screw 23 moves back into the guide rod 30, so that the flexible rope 50 is loosened. Then the pulley actuator returns to its initial position due to the weight of the bed or table it supports. When the screw 23 retracts inward the guide rod 30 to a retracting limit, the guide seat 33 pushes the distal end of the short shaft 631 so that the retracting limit switch 63 triggered by the short shaft 631 sends a stop signal to stop the motor 20 from operating.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A pulley actuator, comprising:

a motor, outputting a rotational force to a reducing mechanism through a coupling device for the reducing mechanism to transmit the rotational force to a screw that is coupled with a guide rod, wherein the guide rod has one end adjacent to the screw provided with a guide seat, and an opposite end equipped with a first pulley, in which the guide seat includes a second pulley set at a lateral thereof;

a tube assembly, including a first tube, a second tube and a third tube telescoped in an outward order, wherein the first tube is coaxially mounted around the screw, and a sleeve coaxially extends inside the third tube from a distal end of the third tube toward the reducing mechanism for receiving the guide rod therein, the sleeve having a pressing block set as a proximal end thereof; and a flexible rope, having one end fixed to the reducing mechanism and an opposite end passing around the first pulley and the second pulley, and then fixed inside a distal end of the first tube with a middle portion pressed by the pressing block;

whereby, when the motor drives the screw and the guide rod to relatively expand or retract, the flexible rope draws the sleeve to move correspondingly.

2. The pulley actuator of claim 1, wherein the distal end of the third tube is formed as a bottom and the sleeve coaxially extends inside the third tube from the bottom toward the reducing mechanism.

3. The pulley actuator of claim 2, wherein a positioning seat is set at a proximal end of the sleeve and the positioning seat has an axial hole for receiving the guide rod.

4. The pulley actuator of claim 3, wherein a recess is provided at a lateral of the positioning seat for allowing the pressing block to be screwed thereto, thereby clamping the flexible rope between the positioning seat and the pressing block.

5. The pulley actuator of claim 1, wherein an adjustment base formed with a threaded hole is provided at a lateral of the reducing mechanism, and an adjustment member is set at one end of the flexible rope to be screwedly coupled with the threaded hole of the adjustment base.

6. The pulley actuator of claim 1, wherein a fixing seat is fixed inside the distal end of the first tube and the fixing seat is peripherally formed with a groove.

7. The pulley actuator of claim 6, wherein the end of the flexible rope fixed inside the distal end of the first tube is formed as a looped portion to be coupled with the groove.

8. The pulley actuator of claim 1, wherein the guide seat is such configured that it is prevented from rotating in the first tube.

9. The pulley actuator of claim 1, wherein a sensing seat provided outside the screw of the reducing mechanism carries an expanding limit switch that comprises a long shaft passing successively through the sensing seat and the guide seat, and being equipped with a retaining nut at a distal end thereof, the long shaft having a length approximately equal to a maximum distance between the guide seat and the expanding limit switch.

10. The pulley actuator of claim 9, wherein the sensing seat further comprises a retracting limit switch that comprises a long shaft passing through the sensing seat and having a distal, free end jutting out of the sensing seat.

* * * * *